US009790754B2

(12) United States Patent
Murphree et al.

(10) Patent No.: US 9,790,754 B2
(45) Date of Patent: Oct. 17, 2017

(54) PLUGGING OF A FLOW PASSAGE IN A SUBTERRANEAN WELL

(71) Applicant: HALLIBURTON ENERGY SERVICES, INC., Houston, TX (US)

(72) Inventors: Zachary R. Murphree, Dallas, TX (US); Michael L. Fripp, Carrollton, TX (US); Zachary F. Walton, Coppell, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 326 days.

(21) Appl. No.: 14/434,538

(22) PCT Filed: Apr. 16, 2014

(86) PCT No.: PCT/US2014/034275

§ 371 (c)(1),
(2) Date: Apr. 9, 2015

(87) PCT Pub. No.: WO2015/160338

PCT Pub. Date: Oct. 22, 2015

(65) Prior Publication Data

US 2015/0300115 A1 Oct. 22, 2015

(51) Int. Cl.

| | |
|---|---|
| ***E21B 33/12*** | (2006.01) |
| ***E21B 34/14*** | (2006.01) |
| ***E21B 43/14*** | (2006.01) |
| ***E21B 23/06*** | (2006.01) |

(52) U.S. Cl.

CPC ..... *E21B 23/06* (2013.01); *E21B 33/12* (2013.01); *E21B 34/14* (2013.01); *E21B 43/14* (2013.01)

(58) Field of Classification Search

CPC ..... E21B 34/14; E21B 23/06; E21B 23/02; E21B 43/14; E21B 33/12; E21B 34/06; E21B 34/08

USPC ..... 166/386, 192

See application file for complete search history.

(56) References Cited

U.S. PATENT DOCUMENTS

| | | | |
|---|---|---|---|
| 7,322,417 B2 | 1/2008 | Rytlewski et al. | |
| 8,616,276 B2 | 12/2013 | Tips et al. | |
| 2010/0032155 A1 | 2/2010 | Darnell et al. | |
| 2011/0155379 A1* | 6/2011 | Bailey | E21B 19/16 166/324 |

(Continued)

OTHER PUBLICATIONS

"Shadow Frac Plugs—Eliminate post-frac intervention and accelerate return on investment", Baker Hughes, Feb. 2014, 8 pages.

(Continued)

*Primary Examiner* — George Gray
(74) *Attorney, Agent, or Firm* — Locke Lord LLP

(57) ABSTRACT

A method of plugging a flow passage in a well can include conveying a plug into an isolation tool in the well, and then contracting a plug seat of the isolation tool. An isolation tool for plugging a flow passage in a subterranean well can include a piston, and a longitudinally displaceable plug seat. The plug seat longitudinally displaces in response to displacement of the piston. Another method of plugging a flow passage can include conveying a plug into an isolation tool in the well, and then longitudinally displacing a plug seat of the isolation tool, thereby radially contracting the plug seat.

16 Claims, 11 Drawing Sheets

(56) References Cited

U.S. PATENT DOCUMENTS

| | | | | |
|---|---|---|---|---|
| 2012/0261115 | A1* | 10/2012 | Xu | E21B 34/14<br>166/193 |
| 2012/0279722 | A1 | 11/2012 | Murray et al. | |
| 2013/0048290 | A1 | 2/2013 | Howell et al. | |
| 2013/0161017 | A1 | 6/2013 | King | |
| 2013/0299199 | A1 | 11/2013 | Naedler et al. | |

OTHER PUBLICATIONS

PCT International Search Report and Written Opinion dated Jan. 12, 2015, issued during the prosecution of corresponding PCT International Application No. PCT/US2014/034275, 12 pages.

PCT International Preliminary Report on Patentability dated Oct. 18, 2016, issued during the prosecution of corresponding PCT International Patent Application No. PCT/US2014/034275, 1 page.

* cited by examiner

PLUGGING OF A FLOW PASSAGE IN A SUBTERRANEAN WELL

CROSS-REFERENCE TO RELATED APPLICATION

This application is a national stage under 35 USC 371 of International Application No. PCT/US14/34275, filed on 16 Apr. 2014. The entire disclosure of this prior application is incorporated herein by this reference.

TECHNICAL FIELD

This disclosure relates generally to equipment utilized and operations performed in conjunction with a subterranean well and, in one example described below, more particularly provides an isolation tool for use in a well.

BACKGROUND

It can sometimes be advantageous to be able to permanently or temporarily plug off a flow passage in a well. For example, it may be beneficial to be able to isolate one section of a tubular string from another section. Therefore, it will be appreciated that improvements are continually needed in the art of constructing and utilizing plugging tools for use in wells.

DETAILED DESCRIPTION

Figure 1:
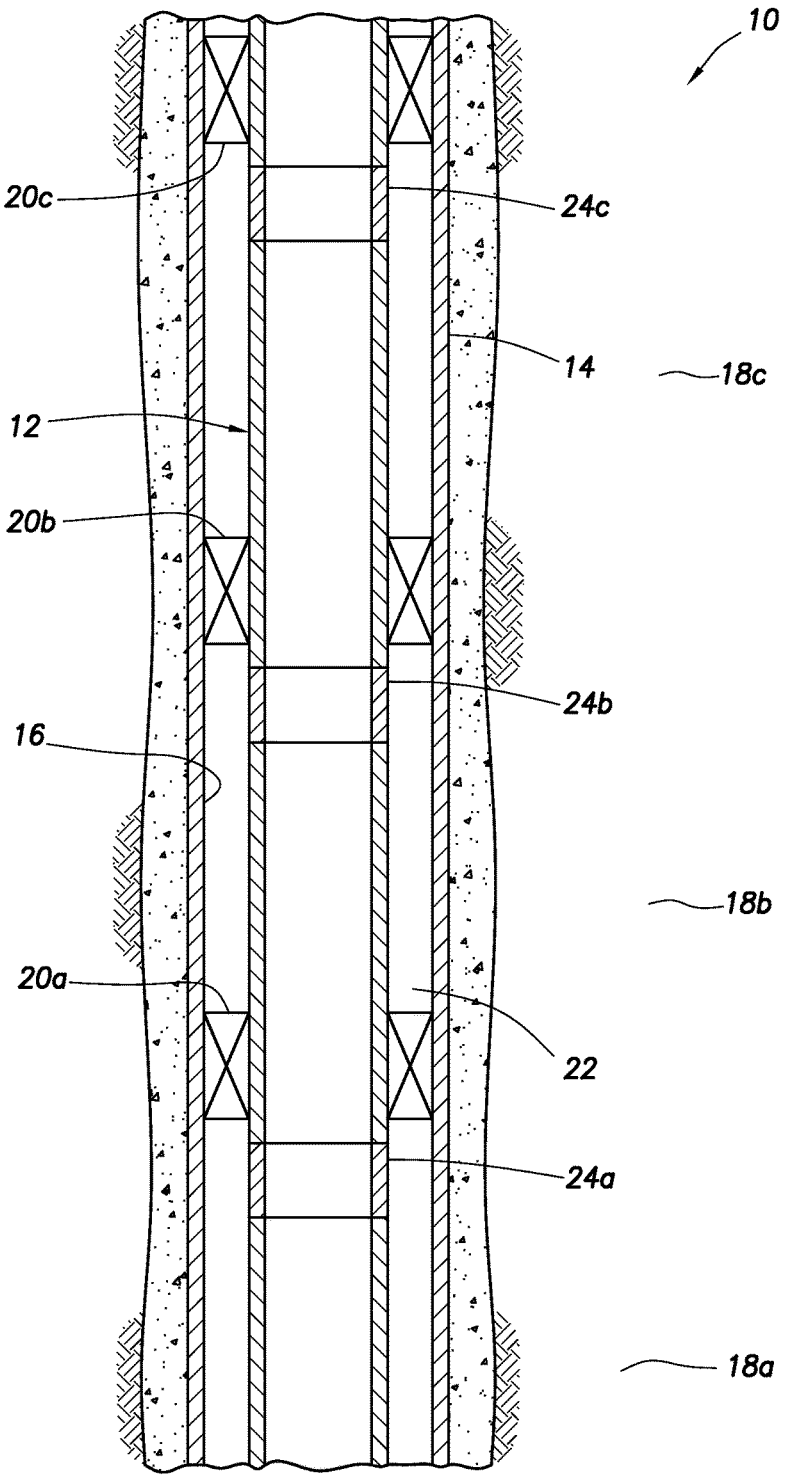
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 (such as, a completion or production string) is positioned in casing 14 cemented in a wellbore 16. In other examples, the tubular string 12 could be positioned in an uncased or open hole section of the wellbore 16, the tubular string could be the casing, the wellbore could be horizontal or inclined, etc. Thus, the scope of this disclosure is not limited to any particular arrangement or configuration of components in the system 10.

It is desired in the system 10 and method to individually fracture multiple formation zones 18*a-c* penetrated by the wellbore 16. Three such zones 18*a-c* are depicted in FIG. 1, but any number of zones can be treated, stimulated, fractured, etc. Thus, the scope of this disclosure is not limited to any particular number of zones, or to any particular operation performed for those zones.

The tubular string 12 includes packers 20*a-c* for sealing off an annulus 22 formed radially between the tubular string and the casing 14 (or wellbore 16). As depicted in FIG. 1, the casing 14 is not perforated, and the annulus 22 is not otherwise in communication with the zones 18*a-c*, but the packers 20*a-c* will be useful for isolating the zones from each other when the annulus is in communication with the zones.

The tubular string 12 also includes isolation tools 24*a-c*. For illustration purposes, each of the isolation tools 24*a-c* is depicted in FIG. 1 as being positioned longitudinally between a respective one of the packers 20*a-c* and an area of the tubular string 12 and the casing 14 to be perforated for a corresponding one of the zones 18*a-c*. However, this positioning of the isolation tools 24*a-c* may not be desirable in some circumstances.

For example, it would not be necessary to position an isolation tool above an uppermost zone to be fractured. So, if zone 18*c* is the uppermost zone, the isolation tool 24*c* may not be used. As another example, it would generally be desirable to plug the tubular string 12 below an lowermost zone to be fractured. So, if the zone 18*a* is the lowermost zone, another isolation tool (or a bridge plug or another type of plug) can be positioned below that zone. Thus, the scope of this disclosure is not limited to any particular positions or relative positions of isolation tools in the system 10.

Figure 2:
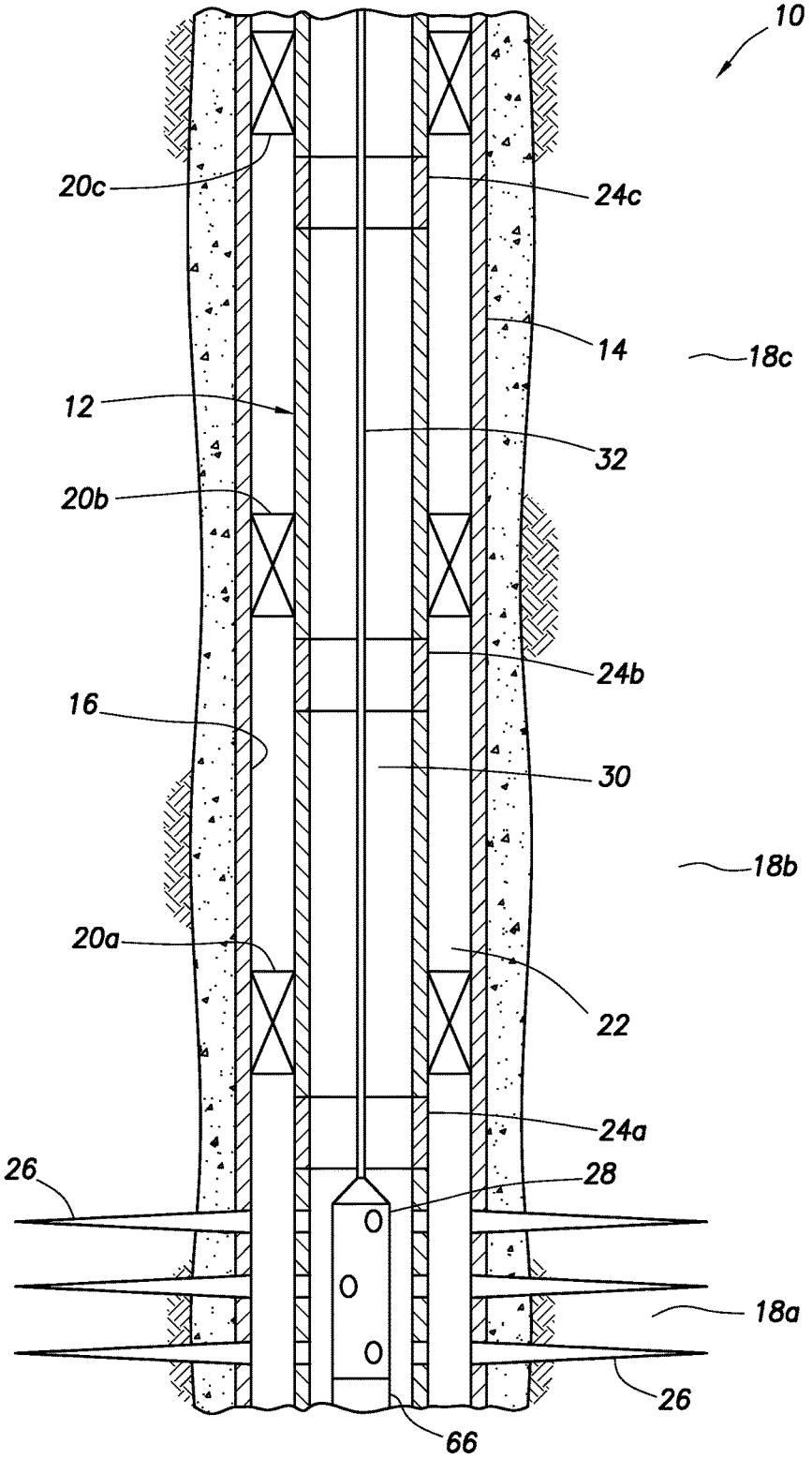
FIG. 2 is a representative partially cross-sectional view of the system and method, in which a zone has been perforated.

Referring additionally now to FIG. 2, the system 10 is representatively illustrated after the zone 18*a* has been perforated. Perforations 26 are formed through the tubular string 12 and casing 14 by a perforating gun 28 conveyed into a flow passage 30 of the tubular string on a conveyance 32.

The conveyance 32 may be a wireline, slickline, coiled tubing or another type of conveyance. In this example, the conveyance 32 is capable of accurately positioning the perforating gun 28 for forming the perforations 26 through the tubular string 12, casing 14 and into the zone 18*a*.

When the perforations 26 are formed, the annulus below the packer 20*a* is placed in communication with the zone 18*a*. Fluids can now be flowed from the flow passage 30 into the zone 18*a* (e.g., in stimulation, fracturing, conformance, steam- or water-flooding operations, etc.), and fluids can be produced from the zone into the tubular string 12.

A shifting tool 66 is depicted in FIG. 2 as being connected below the perforating gun 28. Use of the shifting tool 66 is described more fully below, but it should be understood that it is not necessary to connect the shifting tool below the perforating gun 28. For example, the shifting tool 66 could be connected above the perforating gun 28, or could be separately conveyed into the passage 30.

Figure 3:
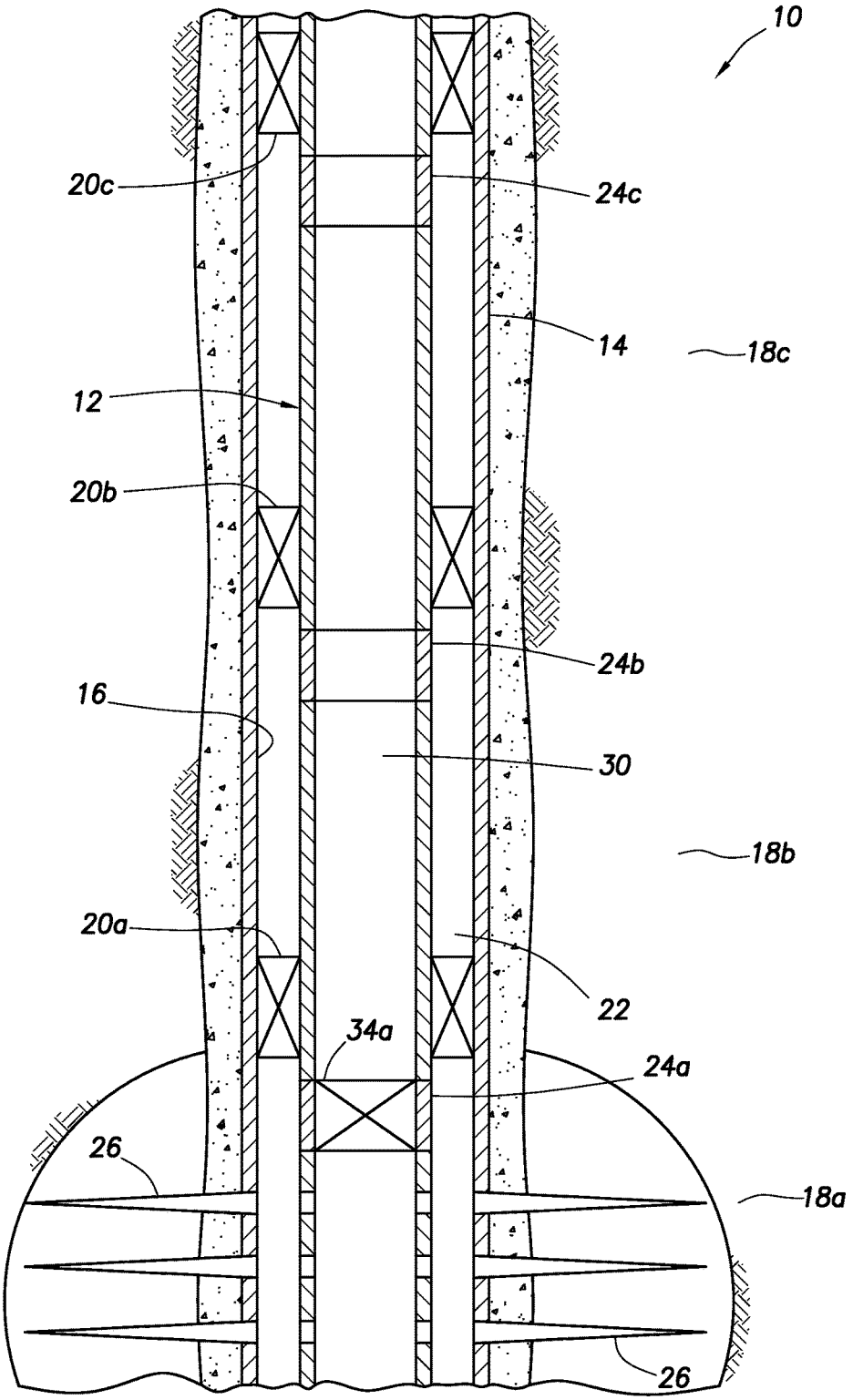
FIG. 3 is a representative partially cross-sectional view of the system and method, in which the zone has been fractured and a plug has been set in a tubular string to thereby isolate the fractured zone.

Referring additionally now to FIG. 3, the system 10 is representatively illustrated after the zone 18*a* has been fractured. Fracturing of the zone 18*a* can be accomplished by flowing fluids, proppant, etc., from the tubular string 12 into the zone via the perforations 26.

After the zone 18*a* is fractured, a plug 34*a* is set in the isolation tool 24*a*. This isolates the zone 18*a* from the flow passage 30 above the plug 34*a*, so that the flow passage above the plug can be used for perforating and fracturing the other zones 18*b,c*, without communicating with the fractured zone 18*a*.

Each of the other zones 18*b,c* can be perforated and fractured as described above for the zone 18*a*. After each zone 18*b,c* is perforated and fractured, a plug is set in a respective one of the isolation tools 24*b,c* to isolate that zone.

Figure 4:
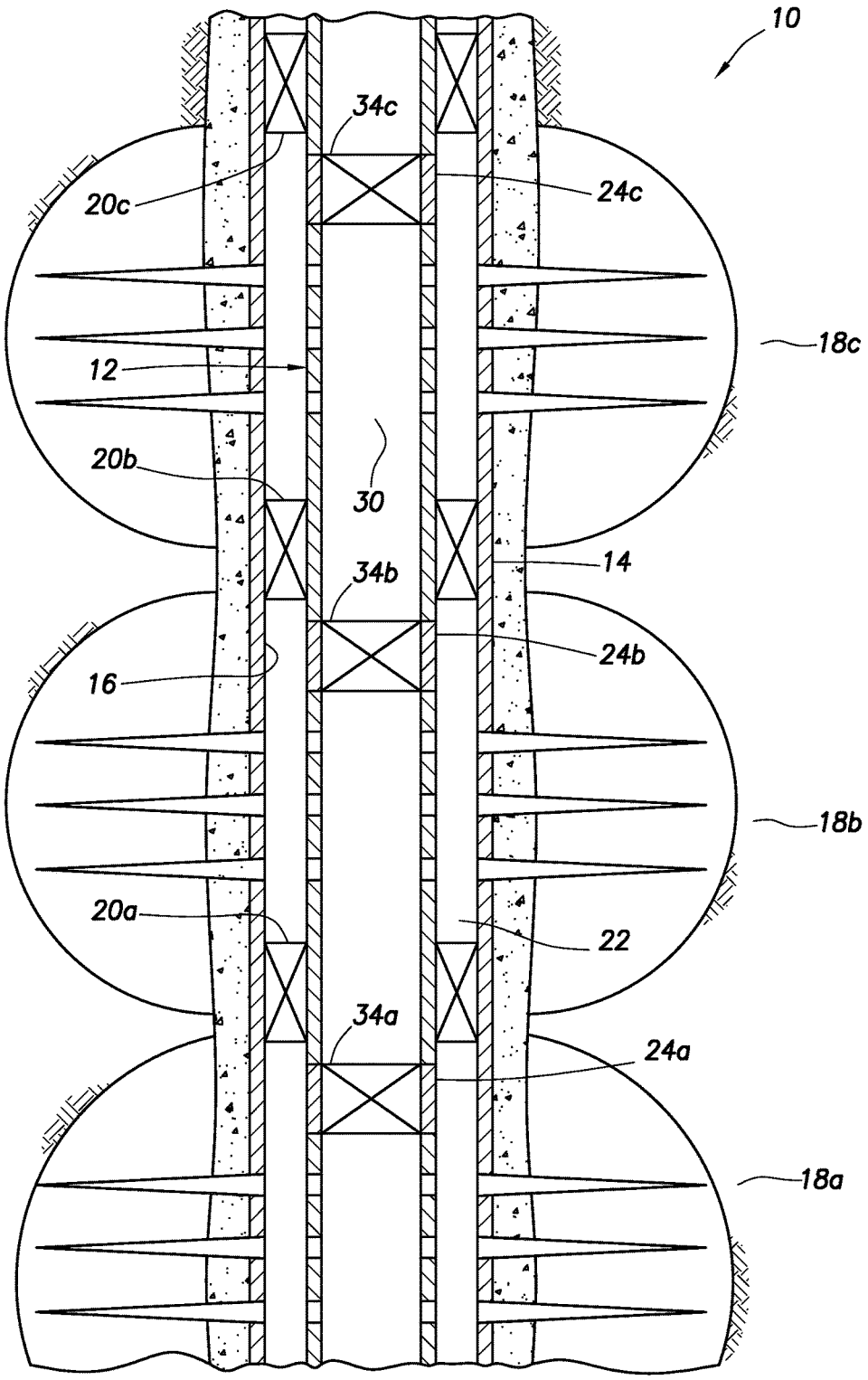
FIG. 4 is a representative partially cross-sectional view of the system and method, in which multiple zones have been perforated, fractured and then isolated with plugs.

Referring additionally now to FIG. 4, the system 10 is representatively illustrated after the zones 18*a-c* have been perforated and fractured. Additional zones (not shown) above and/or below the zones 18*a-c* may also be perforated and fractured. Note that plugs 34*a-c* remain in their respective isolation devices 24*a-c* after the corresponding zones 18*a-c* are fractured.

Figure 5:
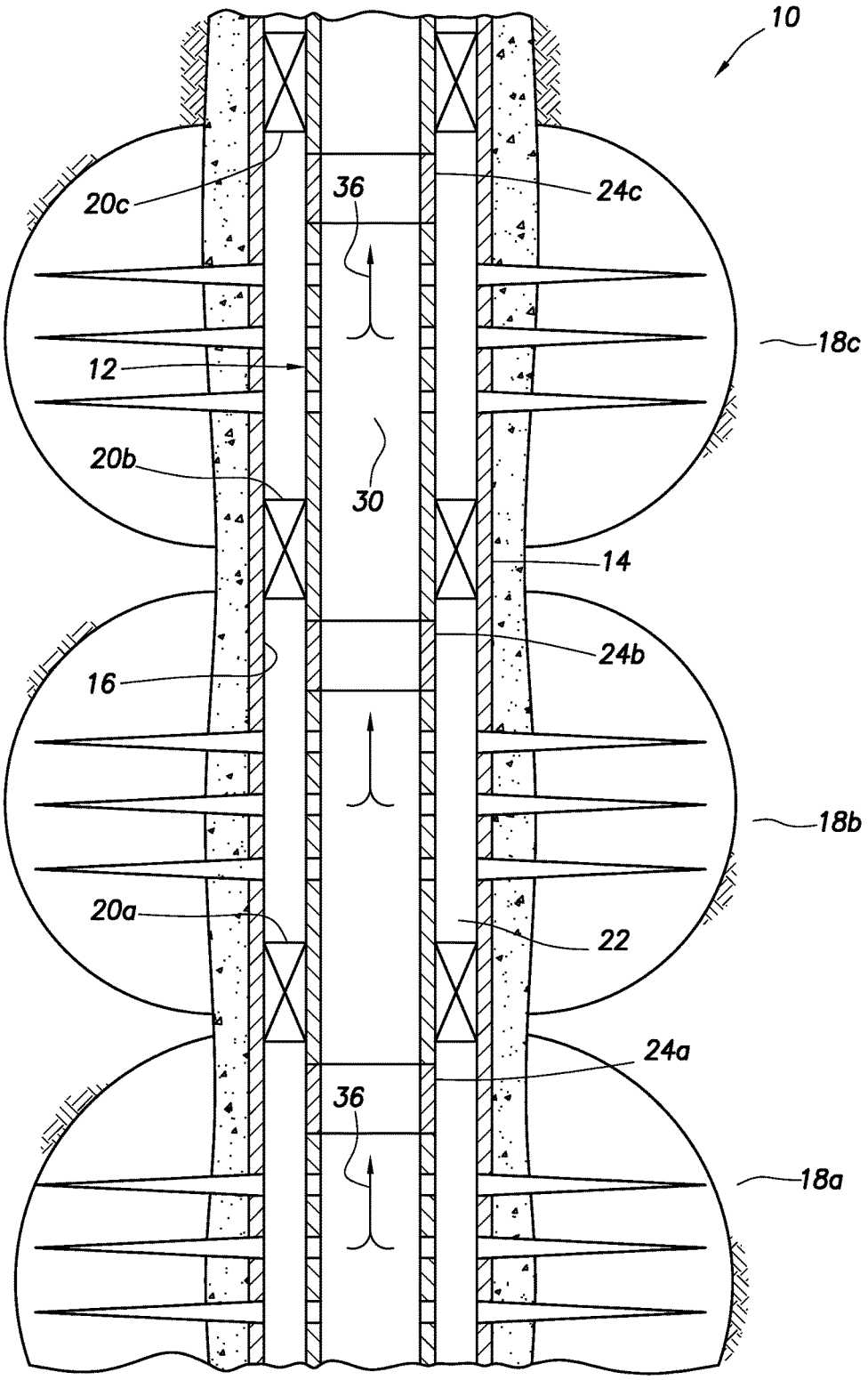
FIG. 5 is a representative partially cross-sectional view of the system and method, in which flow is permitted into the tubular string from each zone.

Referring additionally now to FIG. 5, the system 10 is representatively illustrated after the plugs 34*a-c* no longer block the flow passage 30. In this configuration, fluids 36 can be produced into the tubular string 12 from all of the zones 18*a-c*, and can be flowed via the flow passage 30 to the earth's surface or another location.

The plugs 34*a-c* can be retrieved (such as, by wireline, slickline or coiled tubing), drilled or milled through, or degraded. For example, the plugs 34*a-c* could be made of a material that eventually dissolves, corrodes or disintegrates when exposed to well fluids (such as, the fluids 36 produced from the zones 18*a-c*). Such materials are well known to those skilled in the art.

It will be appreciated that the isolation tools 24*a-c* should be capable of reliably, efficiently and cost effectively isolating sections of the flow passage 30 as the zones 18*a-c* are fractured in succession. In addition, after the fracturing operations are completed, the flow passage 30 should be reliably, efficiently and cost effectively opened for flow of the fluids 36, without significant restriction to flow through the isolation tools 24*a-c*.

Figure 6:
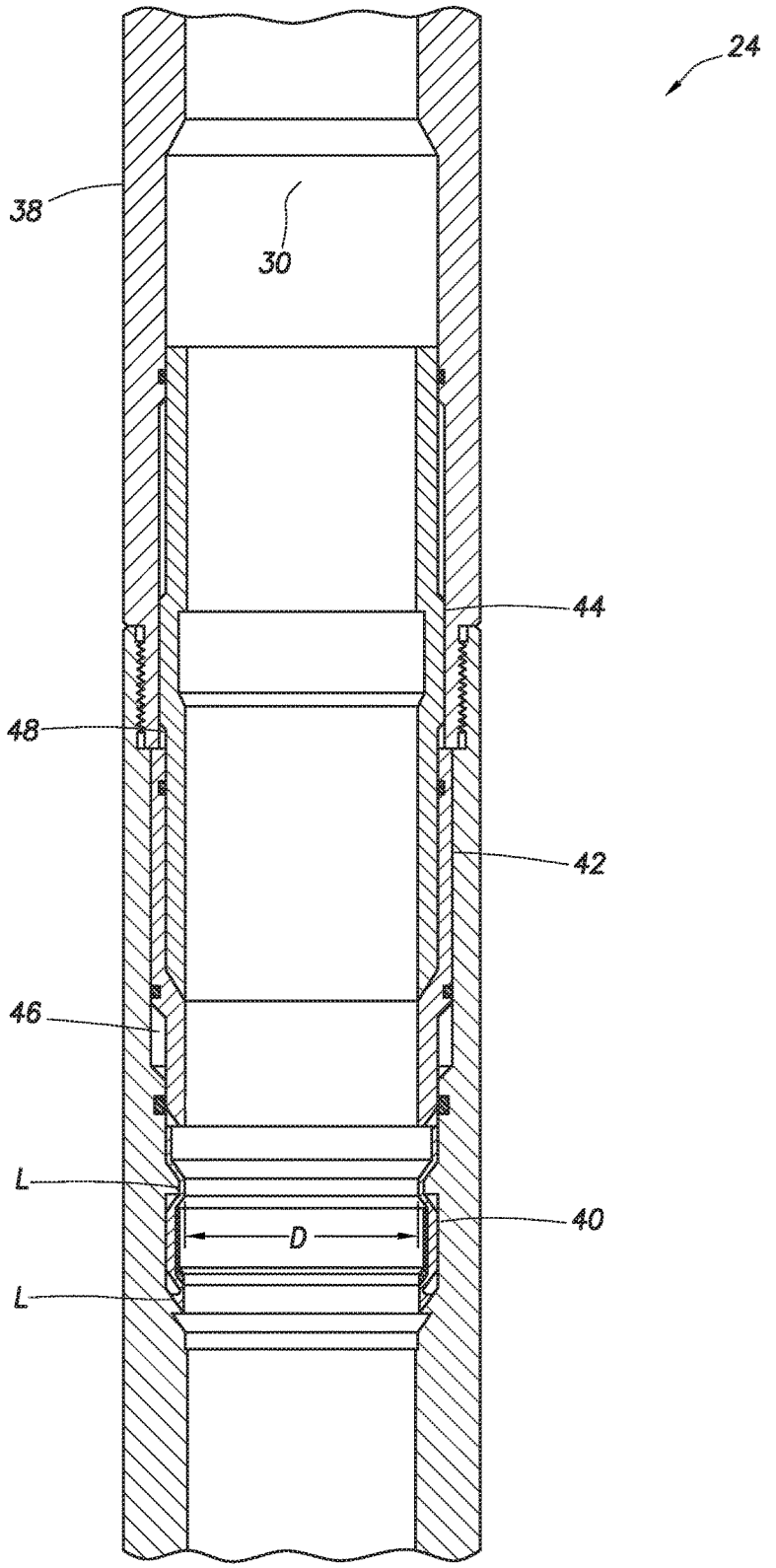
FIG. 6 is a representative cross-sectional view of an isolation tool that can embody the principles of this disclosure.

Referring additionally now to FIG. 6, a representative enlarged scale cross-sectional view of an isolation tool 24 that can be used for any of the isolation tools 24*a-c* in the system 10 and method of FIGS. 1-5 is illustrated. However, the isolation tool 24 may be used in other systems and methods in keeping with the principles of this disclosure.

In the FIG. 6 example, the isolation tool 24 includes an outer housing 38 configured for connecting in the tubular string 12, so that the flow passage 30 extends longitudinally through the isolation tool. The isolation tool 24 also includes a plug seat 40, a piston 42 and a closure 44.

The plug seat 40 is specially configured for sealingly engaging a plug 34 (see FIG. 9) to block flow through the passage 30. The plug 34 can also be considered a component of the isolation tool 24, but the plug is not installed in the isolation tool until after the isolation tool is positioned in the well and it is desired to block flow through the passage 30.

The plug seat 40 contracts radially inward when it is longitudinally displaced by the piston 42. When longitudinally displaced, a minimum internal diameter D of the plug seat 40 is reduced at two longitudinally spaced apart locations L, thereby retaining the plug 34 in the plug seat and providing for sealing engagement between the plug and the plug seat.

In the FIG. 6 configuration, the internal diameter D of the plug seat 40 is approximately equal to a minimum internal diameter of a remainder of the isolation tool 24, and so the plug seat does not present a restriction to flow through the isolation tool. When the plug seat 40 is inwardly contracted, the internal diameter D is preferably only somewhat smaller than the minimum internal diameter of the remainder of the isolation tool 24, and so even when contracted the plug seat does not present a significant restriction to flow.

The piston 42 is in annular form. Annular chambers 46, 48 exposed to the piston 42 are at a same, relatively low (e.g., atmospheric), pressure and are dimensioned so that the piston 42 is longitudinally pressure balanced in the FIG. 6 configuration (there is no net longitudinal force on the piston resulting from pressure applied to the piston). A shear pin, snap ring or other releasable retaining device may nevertheless be used to retain the piston 42 in its FIG. 6 position until it is desired for the piston to displace.

The closure 44 is also in annular form, and is longitudinally pressure balanced. A shear pin, snap ring or other releasable retaining device may nevertheless be used to retain the closure 44 in its FIG. 6 position until it is desired for the closure to displace.

Upward displacement of the closure 44 is used to expose the chamber 48 to well pressure, thereby unbalancing the piston 42, and biasing the piston to displace downward and longitudinally displace the plug seat 40. This process is performed, as described more fully below, after the isolation tool 24 is installed in the well and the plug 34 is conveyed into the flow passage 30 and positioned in the plug seat 40.

Figure 7:
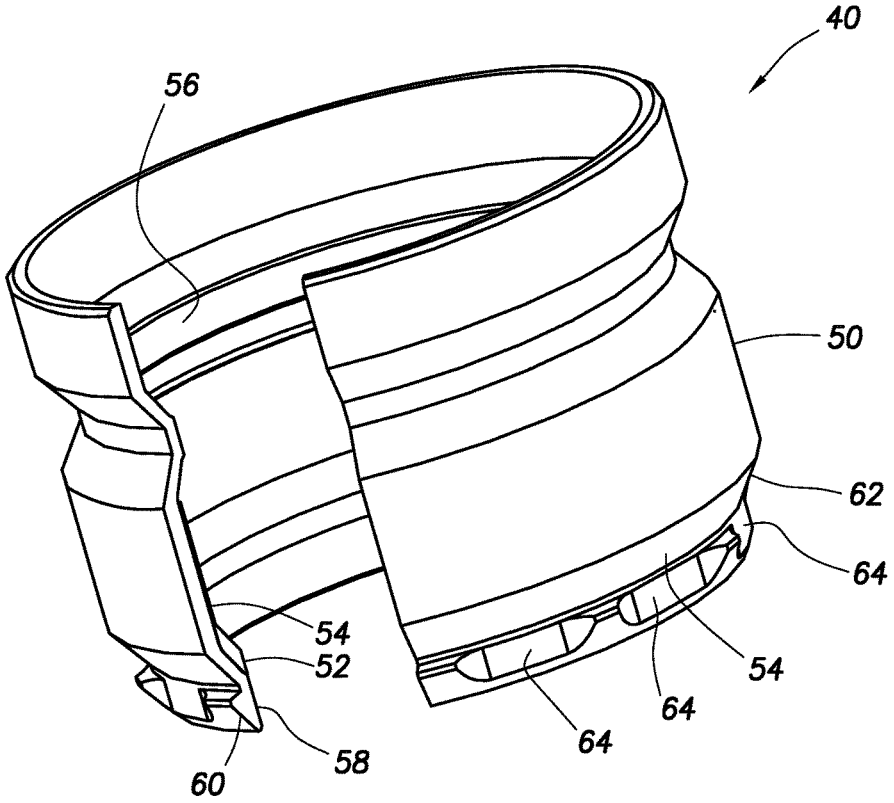
FIG. 7 is a representative perspective section cut view of a plug seat of the isolation tool.
Figure 8:
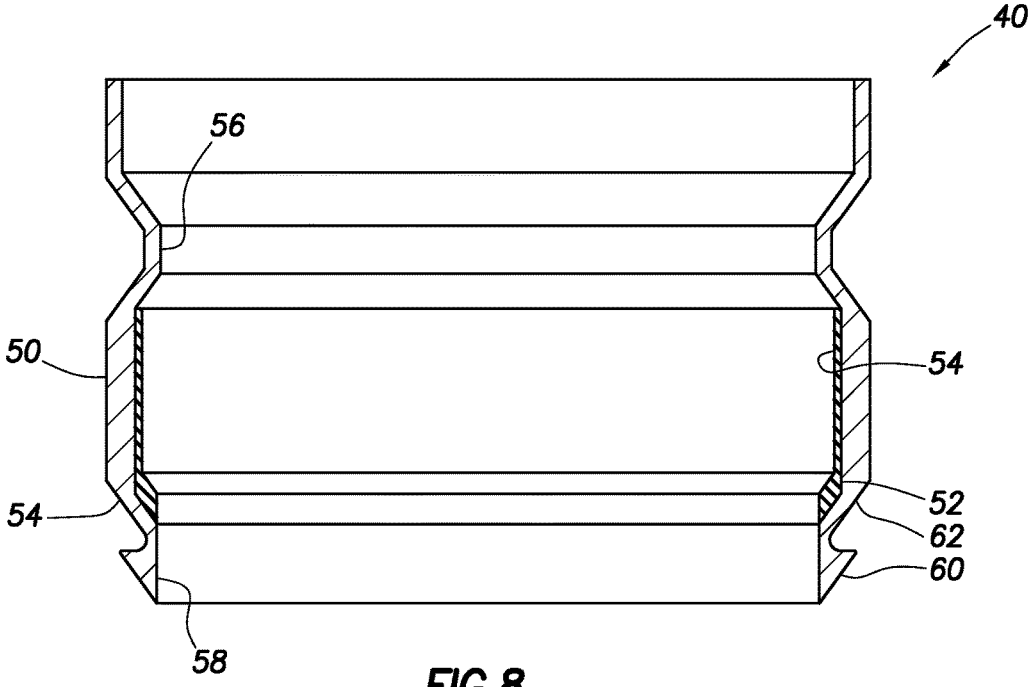
FIG. 8 is a representative cross-sectional view of the plug seat.

Referring additionally now to FIGS. 7 & 8, enlarged scale perspective and cross-sectional views of the plug seat 40 are representatively illustrated. In FIG. 7, it may be seen that a circumferential section of the plug seat 40 is removed, so that the plug seat can be readily compressed circumferentially to thereby reduce the diameter D (see FIG. 6).

The plug seat 40 includes a generally tubular body 50 with a parallelogram-shaped cross-section seal 52 bonded or molded therein. A seal material 54 (such as, a resilient or elastomeric material) may also be bonded or coated on additional external and/or internal surfaces of the body 50.

In some examples, metal-to-metal seals or other non-elastomeric materials may be used to seal between the plug 34 and the plug seat 40, and/or between the plug seat and the outer housing 38. A wear-resistant coating could be bonded or coated on external and/or internal surfaces of the body 50.

The body 50 has a radially reduced portion 56 near its upper end. The radially reduced portion 56 is designed to contract radially inward when the body 50 is longitudinally displaced. When radially contracted, the portion 56 will prevent the plug 34 from displacing upwardly out of the plug seat 40.

Another radially reduced portion 58 is positioned at a bottom end of the body 50. Inclined faces 60, 62 on the radially reduced portion 58 and on an adjacent portion of the body 50 bias the bottom end of the body radially inward when the piston 42 displaces the body downward. In the FIGS. 7 & 8 example, the portion 58 is provided with circumferentially spaced apart recesses 64 in the portion.

Figure 9:
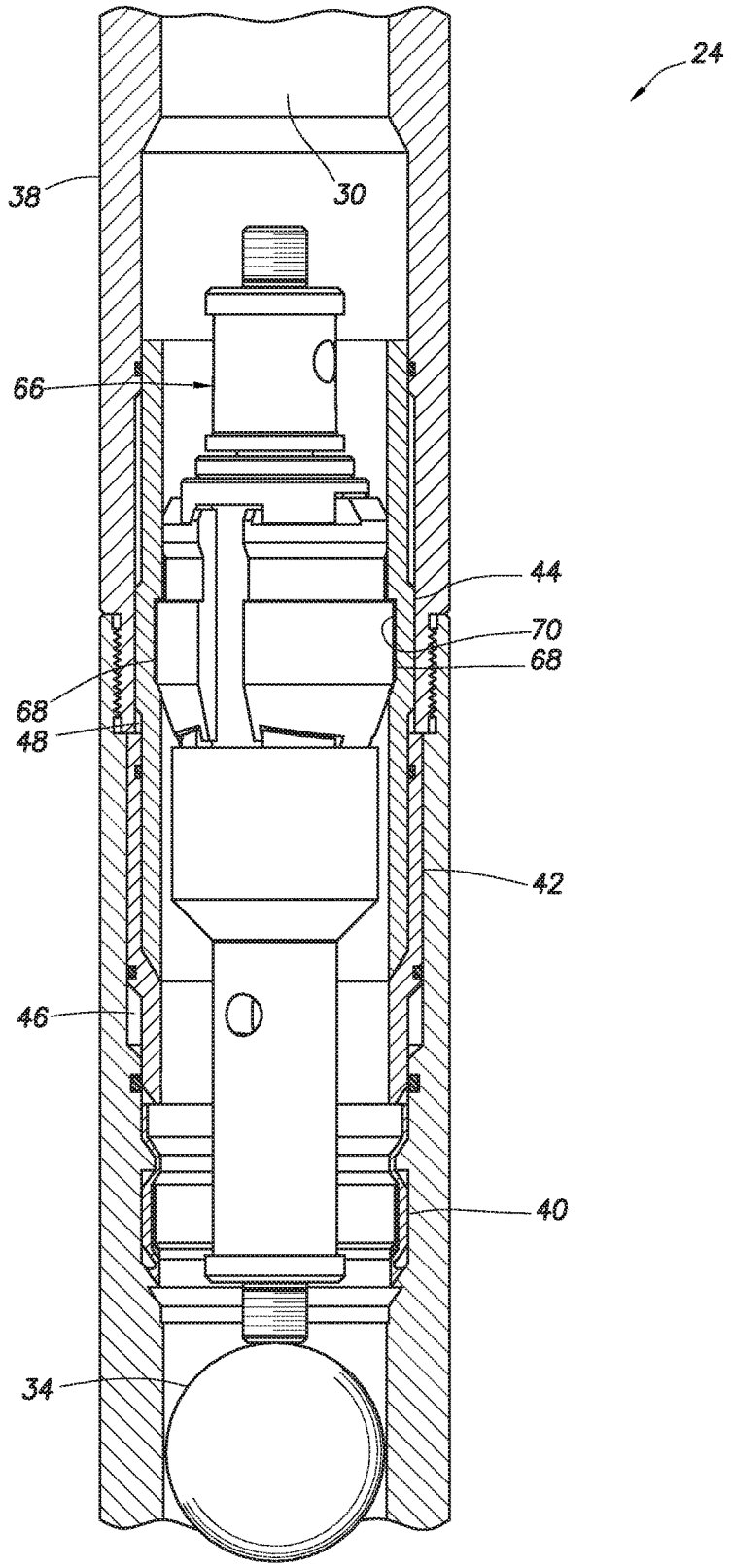
FIG. 9 is a representative cross-sectional view of the isolation tool with a plug conveyed therein on a shifting tool.

Referring additionally now to FIG. 9, the isolation tool 24 is representatively illustrated after installation in the well, and after the plug 34 has been conveyed into the isolation tool. In this example, the plug 34 is in the form of a ball or sphere, but in other examples the plug could have a cylindrical shape or another shape.

The plug 34 is attached to a shifting tool 66 that is adapted to convey the plug into the isolation tool 24, but is otherwise conventional and of the type well known to those skilled in the art. The shifting tool 66 can be conveyed into and through the passage 30 by means of the conveyance 32 (see FIG. 2). The plug 34 in this example can be releasably attached to a lower end of the shifting tool 66 by means of a shear screw (not visible in FIG. 9) or by another releasable retainer.

Shifting dogs 68 of the shifting tool 66 engage a complementarily shaped profile 70 formed in the closure 44, so that, by upwardly displacing the shifting tool, the closure can also be displaced upward. In a preferred manner of operation, the shifting tool 66 with the plug 34 attached thereto is displaced downwardly through the passage 30 in the isolation tool 24 (so that the dogs 68 are displaced below the profile 70 and the plug 34 is displaced below the plug seat 40), and then the shifting tool is displaced upwardly in the isolation tool to engage the dogs 68 with the profile 70 and then to upwardly displace the closure 44 with the shifting tool.

Figure 10:
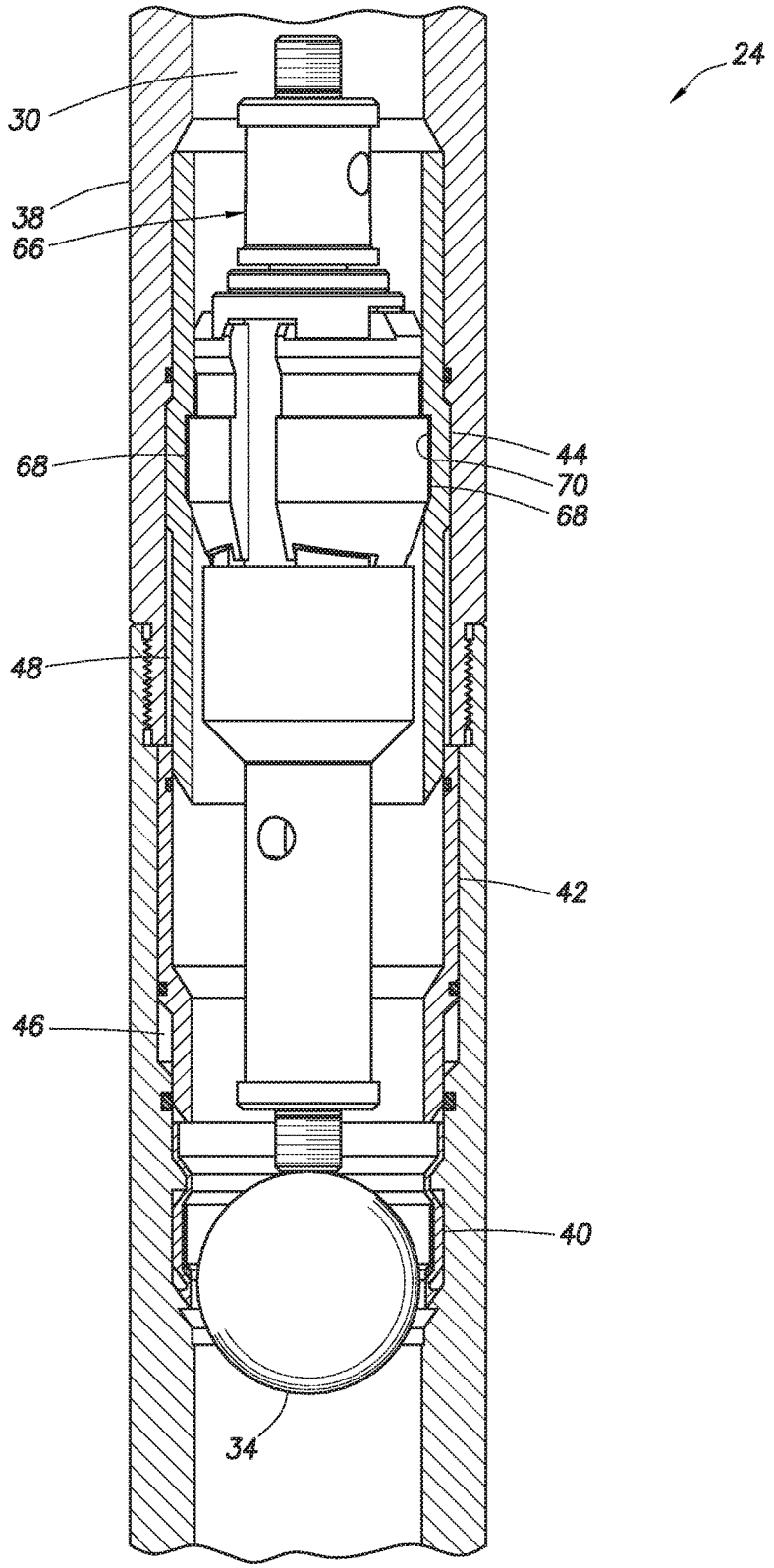
FIG. 10 is a representative cross-sectional view of the isolation tool, in which the shifting tool has shifted a closure of the isolation tool.

Referring additionally now to FIG. 10, the isolation tool 24 is representatively illustrated after the closure 44 has been upwardly displaced by the shifting tool 66. The upward displacement of the closure 44 has now exposed the chamber 48 to well pressure in the passage 30.

Figure 11:
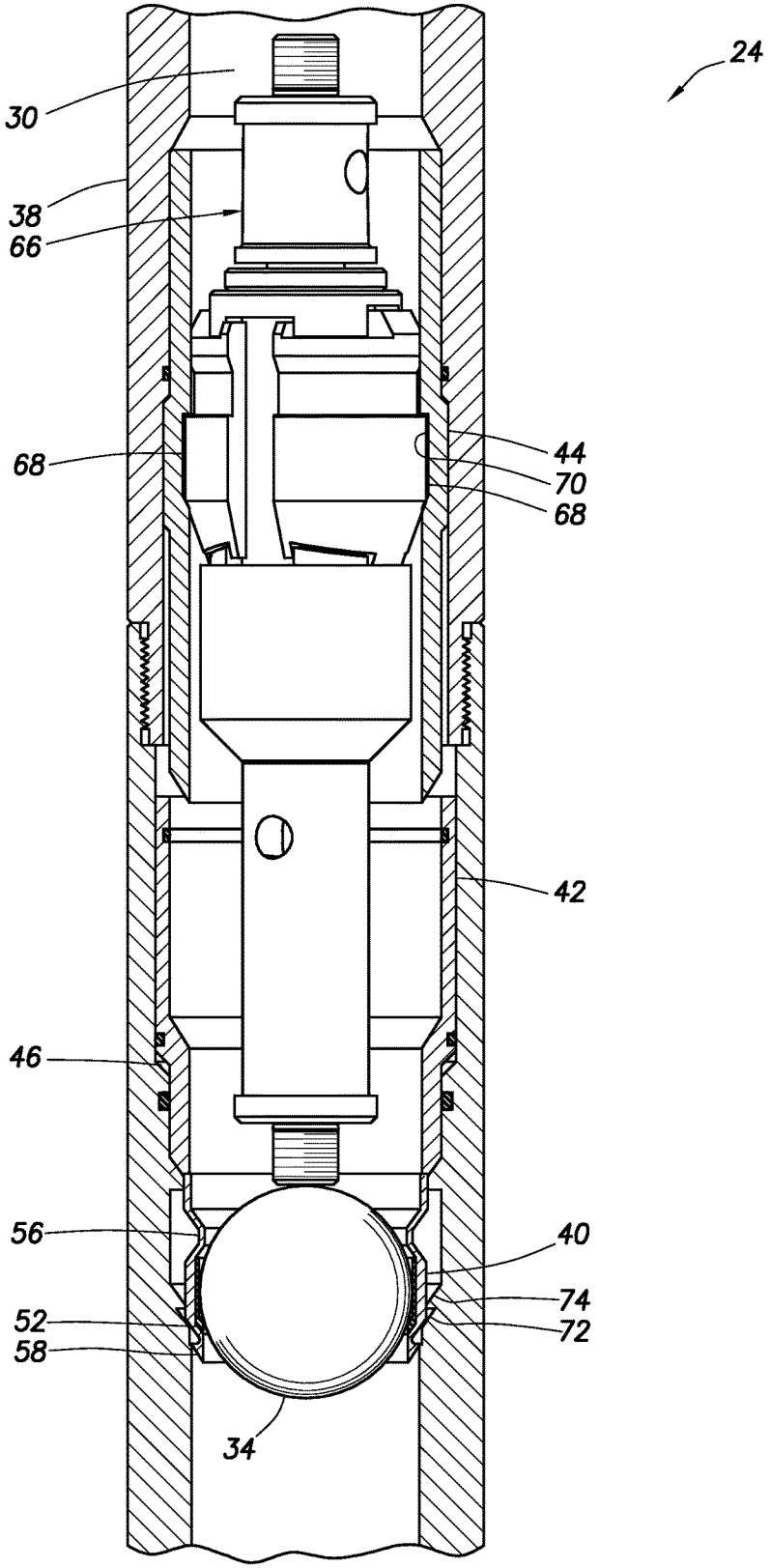
FIG. 11 is a representative cross-sectional view of the isolation tool, in which a piston has displaced and collapsed the plug seat about the plug.

Referring additionally now to FIG. 11, the isolation tool 24 is representatively illustrated after the piston 42 has displaced downwardly. The piston 42 is biased to displace downward when it is no longer longitudinally pressure balanced (due to the chamber 48 being exposed to well pressure in the passage 30).

Note that the plug seat 40 is longitudinally displaced downward by the downward displacement of the piston 42. The isolation tool 24 is dimensioned so that the plug 34 is positioned in the plug seat 40 when the plug seat is longitudinally displaced.

The radially reduced portion 58 and the seal 52 are biased radially inward by inclined faces 72, 74 formed in the housing 38. The inclined faces 72, 74 engage the inclined faces 60, 62 (see FIGS. 7 & 8) formed on the body 50 of the plug seat 40. When the plug seat 40 is displaced downward by the piston 42, the portion 58 and the portion of the plug seat body 50 about the seal 52 are contracted radially inward.

Preferably, the radially reduced portion 56 also contracts radially inward. By radially contracting the portion 56, upward displacement of the plug 34 out of the plug seat 40 is prevented. In this manner, the shifting tool 66 can be retrieved from the passage 30, leaving the plug 34 in the plug seat 40 (e.g., by shearing a shear screw or otherwise releasing the plug from the shifting tool).

Figure 12:
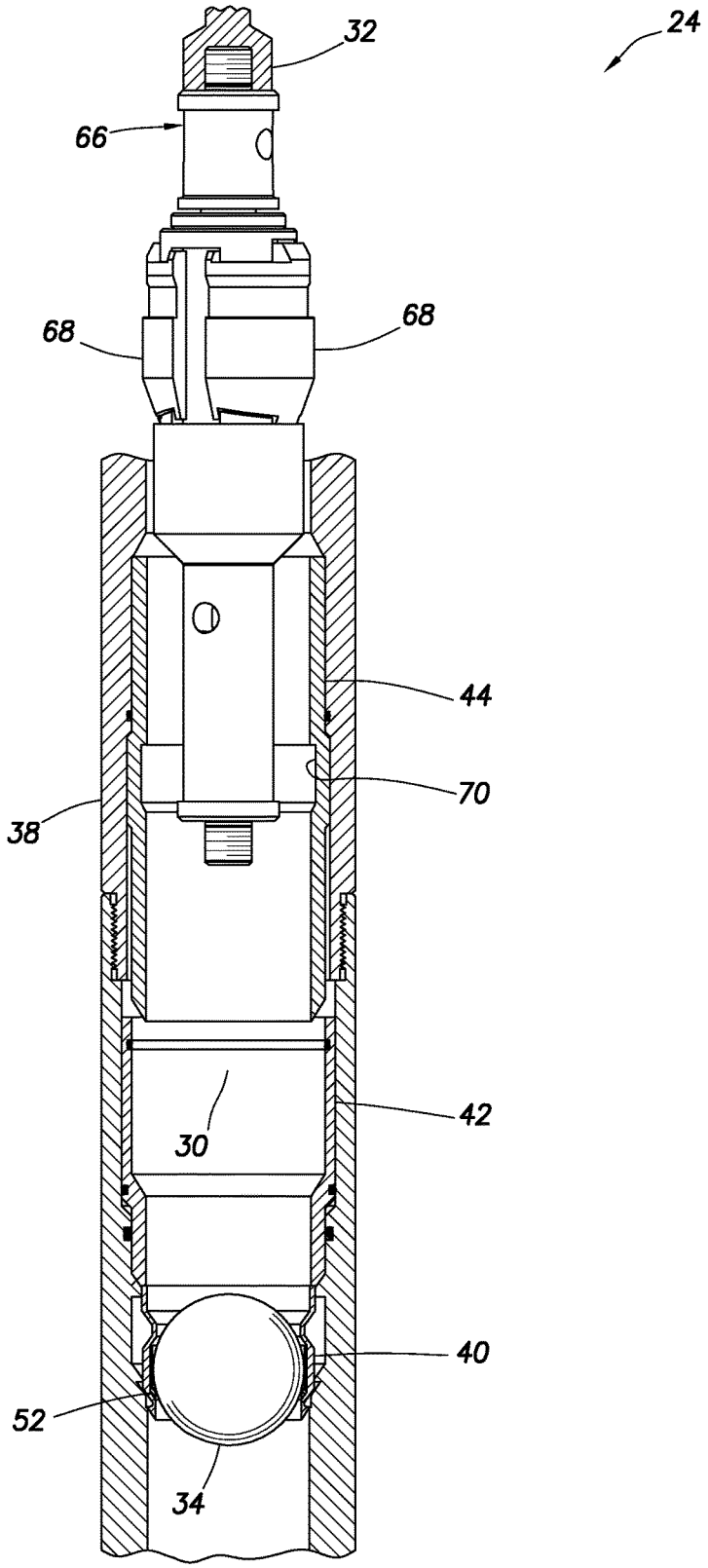
FIG. 12 is a representative cross-sectional view of the isolation tool, in which the plug is separated from the shifting tool.

Referring additionally now to FIG. 12, the isolation tool 24 is representatively illustrated after the plug 34 has been detached from the shifting tool 66. The shifting tool 66 can now be retrieved from the passage 30.

In this configuration, the plug 34 can sealingly engage the seal 52 in the plug seat 40. The seal material 54 (see FIGS. 7 & 8) between the inclined faces 62, 72 can seal between the plug seat body 50 and the housing 38. Increased pressure can now be applied to the passage 30 above the plug 34 (for example, to fracture or otherwise treat a zone above the isolation tool 24), and the passage below the plug will be isolated from the increased pressure.

When it is no longer desired for the plug 34 to block flow through the passage 30, the plug can be dissolved, corroded, eroded, drilled or milled through, or otherwise degraded or dissipated, so that unobstructed flow is permitted through the passage. Only a minimal restriction to flow is then presented by the radially contracted plug seat 40 in the isolation tool 24.

The shifting tool 66 with the plug 34 attached thereto can be conveyed into the isolation tool 24 by the conveyance 32. In some examples, setting the plug 34 in the isolation tool 24 could be combined with perforating a zone, so that only a single trip into the well accomplishes both operations. For example, the perforating gun 28 could be connected between the conveyance 32 and the shifting tool 66, as depicted in FIG. 2.

It may now be fully appreciated that the above disclosure provides significant advances to the art of constructing and operating plugging tools in wells. In examples described above, the isolation tool 24 can be used to conveniently, economically and effectively plug the passage 30, without presenting a substantial restriction to flow through the isolation tool when the passage is again opened.

The above disclosure provides to the art a method of plugging a flow passage 30 in a well. In one example, the method includes conveying a plug 34 into an isolation tool 24 in the well, and then contracting a plug seat 40 of the isolation tool 24.

The conveying step may include lowering the plug 34 while the plug is attached to a conveyance 32. The conveying step may include attaching the plug 34 to a shifting tool 66. The contracting step can comprise opening a closure 44 of the isolation tool 24 with the shifting tool 66.

The plug seat 40 may be circumferentially discontinuous The contracting step can include deforming the plug seat 40 radially inward.

The contracting step may include a piston 42 longitudinally displacing the plug seat 40.

The contracting step can include contracting the plug seat 40 about the plug 34, thereby restricting displacement of the plug in both longitudinal directions through the flow passage 30.

Also provided to the art by the above disclosure is an isolation tool 24 for plugging a flow passage 30 in a well. In one example, the isolation tool 24 comprises a piston 42 and a longitudinally displaceable plug seat 40. The plug seat 40 longitudinally displaces in response to displacement of the piston 42.

The plug seat 40 may radially contract at longitudinally spaced apart locations L in response to displacement of the piston 42. The isolation tool 24 can also comprise a plug 34, at least a portion of the plug being positioned between the spaced apart locations L.

The isolation tool 24 can include a closure 44. The piston 42 may displace in response to displacement of the closure 44 to an open position.

The piston 42 may be longitudinally pressure balanced until displacement of the closure 44 to the open position.

The plug seat 40 may restrict displacement of a plug 34 in both longitudinal directions through the flow passage 30 in response to displacement of the piston 42.

Also described above is a method of plugging a flow passage 30, the method comprising: conveying a plug 34 into an isolation tool 24 in a well, and then longitudinally displacing a plug seat 40 of the isolation tool 24, thereby radially contracting the plug seat 40.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of plugging a flow passage in a subterranean well, the method comprising:

conveying a plug into an isolation tool in the well, wherein the conveying comprises lowering the plug while the plug is attached to a conveyance;

displacing a piston in response to displacing a closure of the isolation tool to an open position; and contracting a plug seat of the isolation tool about the plug in response to the displacing of the piston.

2. The method of claim 1, wherein the conveyance comprises a shifting tool.

3. The method of claim 2, further comprising displacing the closure of the isolation tool with the shifting tool.

4. The method of claim 1, wherein the plug seat is circumferentially discontinuous, and wherein the contracting comprises deforming the plug seat radially inward.

5. The method of claim 1, wherein the contracting comprises the piston longitudinally displacing the plug seat.

6. The method of claim 1, wherein the contracting comprises restricting displacement of the plug in both longitudinal directions through the flow passage.

7. An isolation tool for plugging a flow passage in a subterranean well, the isolation tool comprising:

a piston;

a closure, wherein the piston displaces in response to displacement of the closure to an open position; and a longitudinally displaceable plug seat, wherein the plug seat longitudinally displaces and radially contracts at longitudinally spaced apart locations in response to displacement of the piston.

8. The isolation tool of claim 7, wherein the plug seat is circumferentially discontinuous.

9. The isolation tool of claim 7, further comprising a plug, at least a portion of the plug being positioned between the spaced apart locations.

10. The isolation tool of claim 7, wherein the piston is longitudinally pressure balanced until displacement of the closure to the open position.

11. The isolation tool of claim 7, wherein the plug seat restricts displacement of a plug in both longitudinal directions through the flow passage in response to displacement of the piston.

12. A method of plugging a flow passage in a subterranean well, the method comprising:

conveying a plug into an isolation tool in the well, wherein the conveying comprises lowering the plug while the plug is attached to a conveyance;

displacing a piston in response to displacing a closure of the isolation tool to an open position; and longitudinally displacing a plug seat of the isolation tool in response to the displacing of the piston, thereby radially contracting the plug seat about the plug.

13. The method of claim 12, wherein the conveyance comprises a shifting tool.

14. The method of claim 13, wherein the contracting comprises opening the closure of the isolation tool with the shifting tool.

15. The method of claim 12, wherein the plug seat is circumferentially discontinuous, and wherein the contracting comprises deforming the plug seat radially inward.

16. The method of claim 12, wherein the contracting comprises restricting displacement of the plug in both longitudinal directions through the flow passage.

* * * * *